United States Patent [19]

Jeannin

[11] 4,247,218

[45] Jan. 27, 1981

[54] JOINT FOR THREE-DIMENSIONAL FRAMED STRUCTURES

[76] Inventor: Jean-Louis Jeannin, 6, Avenue Beausejour, Enghein, France, 95800

[21] Appl. No.: 7,829

[22] Filed: Jan. 30, 1979

[30] Foreign Application Priority Data

Feb. 17, 1978 [FR] France ..... 78 04517

[51] Int. Cl.[3] ..... F16D 1/100; F16D 3/00; F16G 11/00

[52] U.S. Cl. ..... 403/217; 403/406; 52/81

[58] Field of Search ..... 403/217, 171, 172, 176, 403/405, 406, 219; 52/81

[56] References Cited

U.S. PATENT DOCUMENTS

| | | | |
|---|---|---|---|
| 3,026,651 | 3/1962 | Richter | 52/81 |
| 3,857,212 | 12/1974 | Barnett | 52/81 |
| 4,122,646 | 10/1978 | Sapp | 403/176 X |
| 4,131,380 | 12/1978 | De Bliquy | 403/217 |
| 4,145,149 | 3/1979 | Ruga | 403/217 |

FOREIGN PATENT DOCUMENTS

| | | | |
|---|---|---|---|
| 2421920 | 11/1975 | Fed. Rep. of Germany | 52/81 |
| 6508364 | 12/1965 | Netherlands | 52/81 |

*Primary Examiner*—Wayne L. Shedd
*Attorney, Agent, or Firm*—Wenderoth, Lind & Ponack

[57] ABSTRACT

A joint for constituting a node of three-dimensional spatial framed structures comprises a convex polyhedral base plate from which angularly spaced pairs of wings extend outwardly, each pair forming a gap in which the flattened end of a longitudinal element of the framed structure is adapted to be inserted. The wings are secured either to the solid angles of intersection between the faces of the base plate or along the center lines of the faces thereof. Holes are provided through the wings and faces, and also through the flattened ends of the elements, for bolting the joint to the elements and to diagonal elements to form superposed flat assemblies interconnected in turn by the diagonal elements.

11 Claims, 6 Drawing Figures

JOINT FOR THREE-DIMENSIONAL FRAMED STRUCTURES

BACKGROUND OF THE INVENTION

The present invention relates in general to three-dimensional framed structures and has specific reference to an improved junction device or joint for assembling the component elements of so-called "spatial" framed structures consisting of superposed flat assemblies of longitudinal elements disposed in a common plane and interconnected by other longitudinal elements disposed in different planes and oriented in various spatial directions, these last-mentioned elements being usually referred to as "diagonal longitudinal elements".

It is the primary object of the invention to provide a joint for framed structures of this character which is simple and therefore economical to manufacture, has minimum dimensions to facilitate the storage and transport thereof, and is also easy to use without resorting to special tools or skilled workers.

Many types of assembling joints consisting of several component elements to be assembled on the site, or hinged multi-directional assemblies, or drilled or tapped spherical members, have already been proposed in the art. However, all these known means either are awkward to assemble on the construction site or require an excessive assembling work on the frame elements, for example by welding, or are more related to mechanics and therefore expensive to manufacture.

It is the essential purpose of this invention to eliminate or at least minimize the shortcomings of hitherto known devices of this character, by providing a device affording:

- a particularly simple and therefore economical manufacture;
- easy storage and transport, in order to cut costs, and
- easy assembling on the site without resorting to special tools or skilled workers.

These various objects are attained according to the present invention by providing an assembling joint for spatial framed structures which consists of a unitary device comprising a regular convex polyhedron having a suitable number of inclined faces to which the so-called "diagonal" elements interconnecting the superposed flat assemblies of elements of the framed structure are attached, this device comprising a plurality of lugs, wings or equivalent means adapted to interconnect the component elements of the same flat assembly. As employed herein, the term "regular convex polyhedron" refers to a base plate which is formed by plural faces which are inclined to each other and which intersect or join at solid lines of intersection to form a convex plate shape.

The various features and advantages of this invention will appear as the following description proceeds with reference to the accompanying drawings illustrating diagrammatically several embodiments of the joint for framed structures according to the invention. Of course, these embodiments are given by way of example and illustration, not of limitation, since the shape, proportions and relative arrangement of the component elements may be varied without departing from the basic principles of the invention.

DESCRIPTION OF THE PREFERRED EMBODIMENTS

Figure 1:
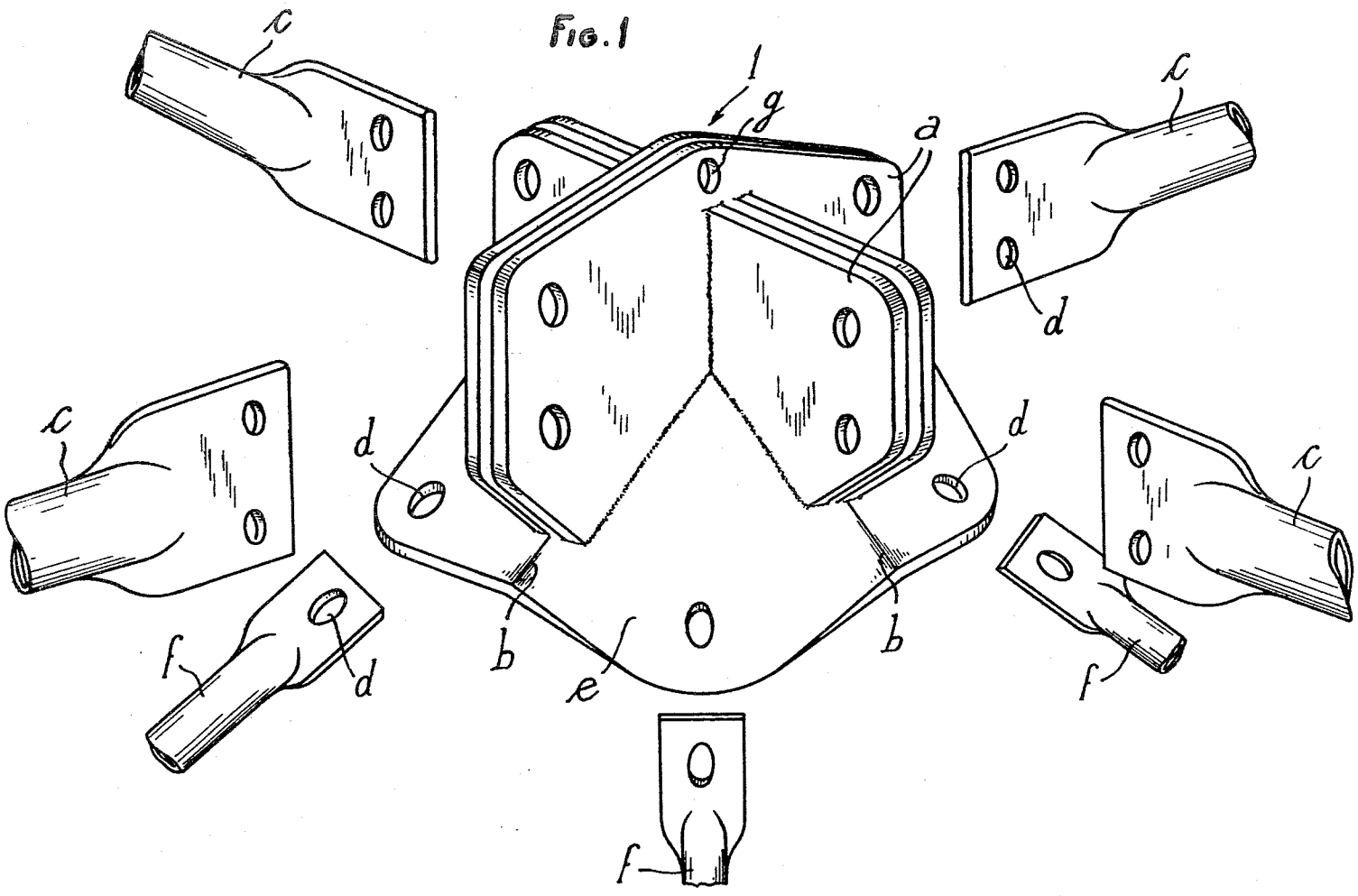
FIG. 1 is an exploded perspective view showing several structure elements to be assembled by means of the joint of this invention, together with a first embodiment of the joint.

In the example illustrated in FIG. 1 the joint 1 according to this invention comprises a sturdy one-piece member or plate of tetrahedral configuration having integral therewith wing means or lugs a. These wing means extending outwardly from the solid angles of intersection b of the inclined faces e of the tetrahedron-shaped plate are adapted to receive the matching ends of component longitudinal elements c of the type mentioned hereinabove for interconnecting them in coplanar relationship into a flat assembly constituting for example a horizontal planar structure of a three-dimensional frame structure, the vertex of the tetrahedron-shaped plate passing through the point of convergence of the various elements c.

In the example illustrated each wing means actually comprises a pair of flat spaced lugs, the gap left therebetween being sufficient for receiving therein a flattened and perforated end of the horizontal elements c to be interconnected. In the embodiment shown in FIG. 1 these elements c are fastened to the joint 1 by means of bolts engaging registering holes d formed through the flattened ends of each element c and the corresponding pair of wings a.

The inclined faces e of the tetrahedron-shaped plate also have holes formed there-through for attachment to one end of oblique elements f, usually referred to as "diagonal" elements, for interconnecting two superposed horizontal flat assemblies of the three-dimensional framed structure.

These diagonal elements f are secured to the joints by using the same means as those utilized for fastening the horizontal elements c thereto.

Figure 2:
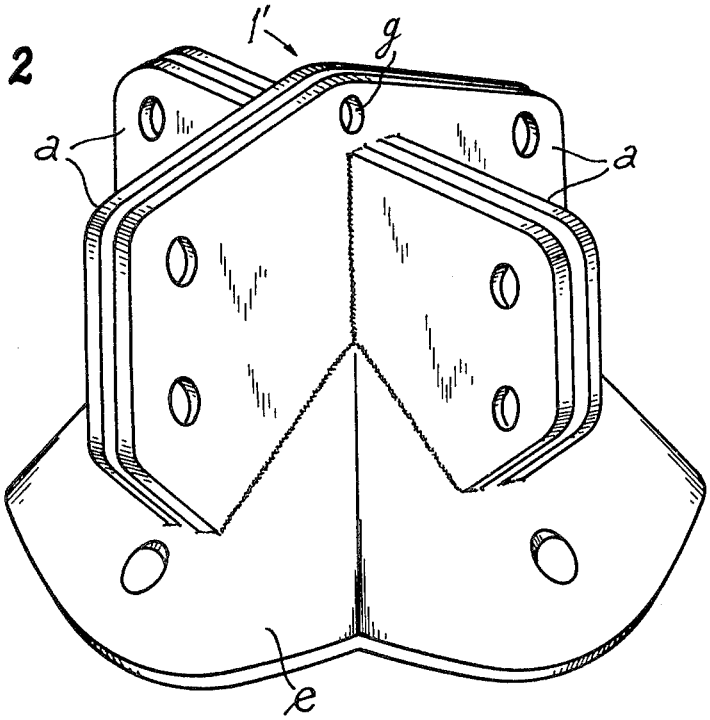
FIGS. 2 and 3 are views similar to FIG. 1 but showing modified embodiments of the joint without the corresponding structure elements.

Thus, by using joints of the type described hereinabove and illustrated in FIGS. 1 and 2, it is possible to construct a three-dimensional framed structure of the type shown in FIG. 4, in which the joints of the lower assembly are drawn in the form of double circles at 1', the diagonal elements being designated by the letter f in triple lines. In this case, a 50 percent "filling" of the structure mesh is obtained.

Figure 5:
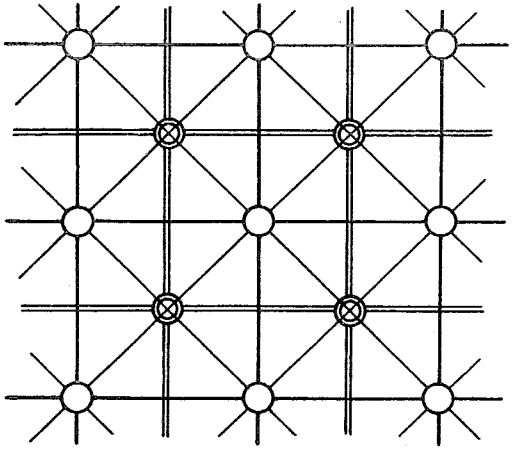
FIGS. 5 and 6 are views similar to FIG. 4 showing framed structures constructed by using the joints of FIGS. 1 and 3, respectively.
Figure 6:
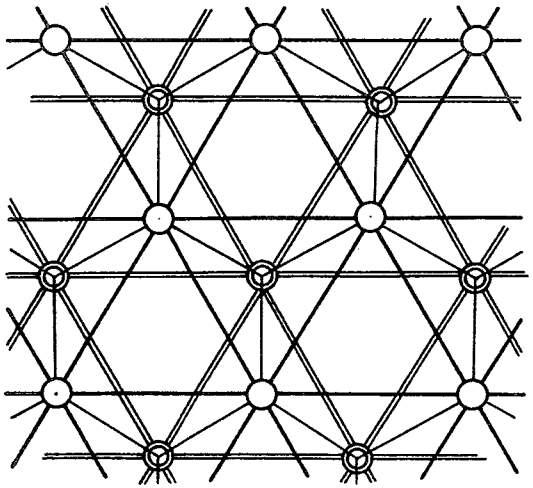
Figure 4:
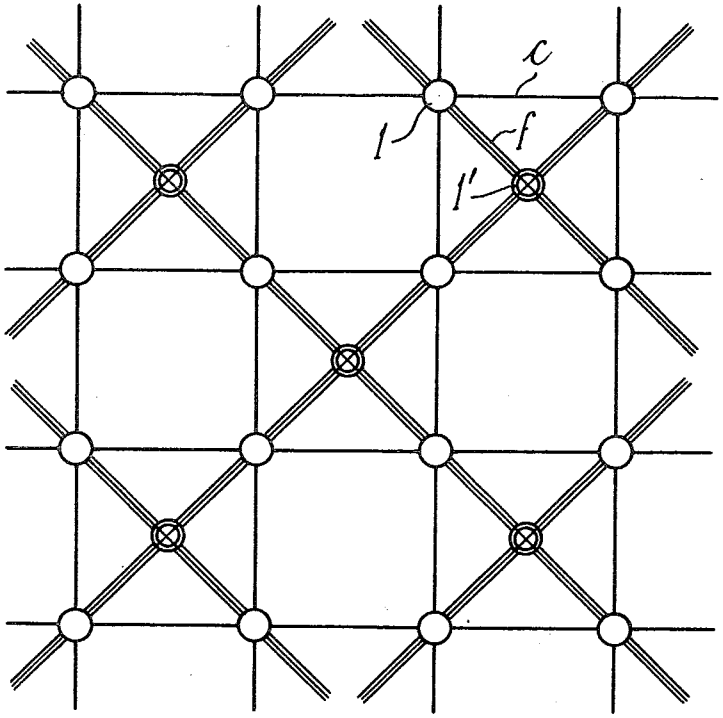
FIG. 4 is a plan view from above showing a three-dimensional framed structure comprising two superposed flat assemblies or planes of elements, this structure incorporating joints of the type shown in FIG. 1 and joints of the type shown in FIG. 2.

A 100 percent filling of the structure mesh as shown in FIG. 5 showing the component elements as in FIG. 4, is obtained by using joints of the type illustrated in FIG. 1.

The joint 1' (FIG. 2) comprises a one-piece assembly or plate of tetrahedral configuration formed with orthogonal wings, but in this case each pair of wings extend from the center line of a corresponding face e of the tetrahedron-shaped plate, so that these faces can be so oriented that four diagonal elements can extend from each joint outwardly, in order to provide the 50 percent filling of the structure mesh as shown in FIG. 4.

In the embodiments illustrated in FIGS. 4 and 5 the three-dimensional framed structures consist of superposed flat assemblies or networks having square or rectangular meshes.

Figure 3:
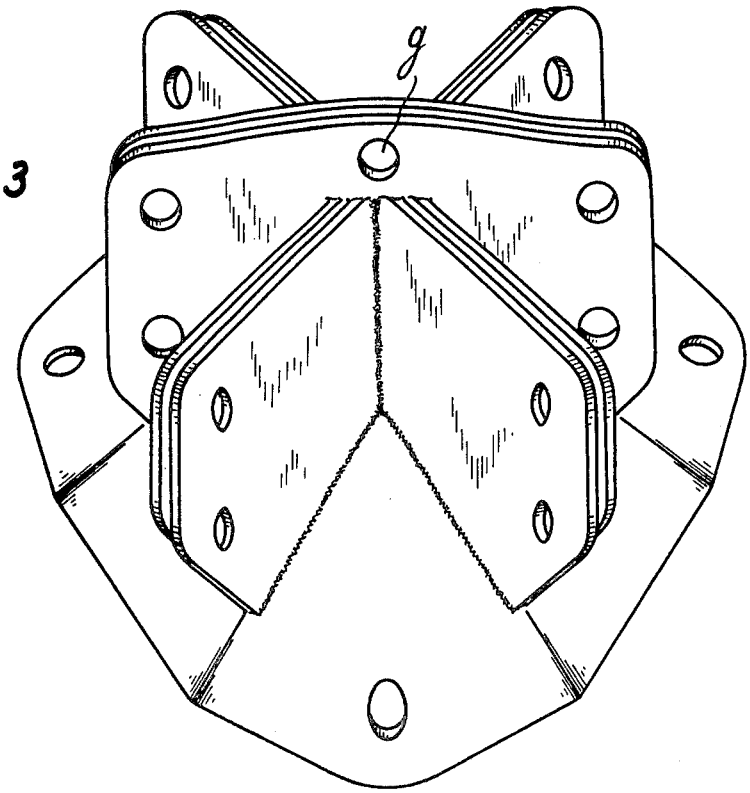

In certain cases the use of superposed flat assemblies consisting of triangular meshes may be preferred for certain framed structures. In this case the joint assording to this invention which is illustrated in FIG. 3 is required. This joint consists of a rigid one-piece member or plate of hexahedral configuration on top of which an assembly of six pairs of wings disposed at spaced angular intervals are provided, so that a 60-degree angle is formed between adjacent pairs of wings.

Generally, the number of faces of the polyhedron is selected as a function of the number of diagonal elements to be attached thereto, and same applies to the number of pairs of wings constituting the means for attaching the longitudinal elements of the flat assemblies or nets, as a function of these elements.

The wing means a may advantageously have an axial hole g formed therethrough to facilitate the fastening of partitions or other panels in case these joints are used for assembling either the component elements of the upper net or flat assembly of the framed structure or the component elements of a false ceiling when they are used for assembling the component elements of the lower net of the framed structure. In fact, it will be seen that in this last case the joints are used in the reverse position, i.e. upside down, with respect to their position when they are incorporated in the upper flat assembly or net.

The one-piece joints according to this invention may be made from any suitable materials. The various component elements may be assembled with each other by using any suitable and known technique, such as welding. They can also be manufactured integrally by moulding, according to the particular material implemented.

The storage and transport of these joints are particularly easy, since they can also be stacked to reduce their volume, notably by using containers or crates. Furthermore, these joints can easily be assembled on the site, by bolting, by unskilled workers and without resorting to special tools whatsoever.

With a reduced number of joint types or models, any desired shapes of three-dimensional framed structure can be obtained.

The longitudinal elements of the framed structure outside these joints, notably the posts, lintels and tierods, may be made from rolled bars, sections, tubes, etc., of adequate cross-sectional dimension and punched at their ends as shown in FIG. 1. These elements can easily be packed into clusters and handle, notably on the site of erection of the projected framed structure.

In the case of relatively small or short elements, it may prove more economical to weld at the factory one longitudinal element on either side of a diagonal to the joint. In this case, two pairs of wings may be dispensed with and only one end of the longitudinal elements c is flattened and punched, the other end being welded directly to the joint.

What is claimed as new is:

1. A joint for use in forming a three-dimensional framed structure of the type including plural superposed and parallelly spaced planar assemblies, each said planar assembly being formed of plural of the joints connected by planar longitudinal elements extending in the plane of the assembly, and diagonal longitudinal elements extending between and connecting the joints of adjacent of the planar assemblies, said joint comprising:

a base member having a regular convex polyhedral-shaped surface formed by a plurality of faces which are inclined with respect to each other and which are joined at solid lines of intersection which converge at a vertex of said surface;

a plurality of lugs integral with and extending outwardly from said surface of said base member, each said lug extending substantially in a plane containing an axis of said base member which extends through said vertex of said surface;

said lugs including means for connection to planar longitudinal elements to join a plurality of the joints to form a planar assembly; and at least a portion of said faces of said surface of said base member including means for connection to diagonal longitudinal elements to join joints of and extend between adjacent planar assemblies.

2. A joint as claimed in claim 1, wherein said lugs are substantially planar members which intersect each other along said axis.

3. A joint as claimed in claim 2, wherein said planar members extend outwardly from said surface at positions coincident with said lines of intersection between said faces.

4. A joint as claimed in claim 2, wherein said planar members extend outwardly from said surface at positions on said faces spaced midway between adjacent said lines of intersection between said faces.

5. A joint as claimed in claim 2, wherein each said planar member comprises a pair of parallel spaced wings having a space therebetween dimensioned to receive therein an end of a respective planar longitudinal element.

6. A joint as claimed in claim 5, wherein said means for connection to said planar longitudinal elements of each said planar member comprises aligned holes in said parallel spaced wings adapted to align with a hole in the end of the respective planar longitudinal element and dimensioned to receive a connecting bolt.

7. A joint as claimed in claim 5, wherein at least one of said pair of parallel spaced wings further includes hole means for facilitating the attachment of a partition to the joints of a planar assembly.

8. A joint as claimed in claim 2, wherein at least one said planar member has fixed thereto a respective said planar longitudinal element.

9. A joint as claimed in claim 1, wherein said means for connection to said diagonal longitudinal elements comprises bolt receiving holes in said faces.

10. A joint as claimed in claim 1, wherein said surface is defined by four said faces, and said plurality of lugs comprise four said lugs equally spaced about said axis.

11. A joint as claimed in claim 1, wherein said surface is defined by six said faces, and said plurality of lugs comprise six said lugs equally spaced about said axis.

* * * * *